United States Patent [19]

Martinsons et al.

[11] 4,086,149

[45] Apr. 25, 1978

[54] CATHODE ELECTROCATALYST

[75] Inventors: Aleksandrs Martinsons, Wadsworth; Marilyn Crenshaw, Copley, both of Ohio

[73] Assignee: PPG Industries, Inc., Pittsburgh, Pa.

[21] Appl. No.: 711,759

[22] Filed: Aug. 4, 1976

[51] Int. Cl.[2] ..... C25B 1/34; C25B 11/04

[52] U.S. Cl. ..... 204/59 R; 204/38 B; 204/43 P; 204/98; 204/290 R

[58] Field of Search ..... 204/38 B, 209 R, 43 P, 204/59 R, 98

[56] References Cited

U.S. PATENT DOCUMENTS

| | | | |
|---|---|---|---|
| 3,073,762 | 1/1963 | Koretzky | 204/43 P |
| 3,264,199 | 8/1966 | Fassell et al. | 204/43 P |
| 3,291,714 | 12/1966 | Hall et al. | 204/256 |
| 3,303,111 | 2/1967 | Peach | 204/43 P |
| 3,355,267 | 11/1967 | Du Rose | 204/38 X |
| 3,441,495 | 4/1969 | Colman | 204/268 |
| 3,632,498 | 1/1972 | Beer | 204/290 F |
| 3,974,058 | 8/1976 | Gokhale | 204/266 |

FOREIGN PATENT DOCUMENTS

| | | | |
|---|---|---|---|
| 1,244,503 | 9/1971 | United Kingdom | 204/43 P |
| 1,288,620 | 9/1972 | United Kingdom | 204/38 B |

OTHER PUBLICATIONS

Brenner et al, J. Research, Nat'l Bur. Stand. vol. 44, p. 109, 1/50.

*Primary Examiner*—F.C. Edmundson
*Attorney, Agent, or Firm*—Richard M. Goldman

[57] ABSTRACT

Disclosed is a method of electrolyzing aqueous solutions of alkali metal chlorides, such as sodium chloride brine, where an electrical current is passed from an anode to the cathode, evolving chlorine at the anode and hydrogen at the cathode. According to the disclosed method the cathode has a ferrous substrate with an electroplated coating thereon containing a transition metal. Also disclosed is a method of electroplating the transition metal onto the ferrous cathode substrate from an electroless plating solution.

3 Claims, No Drawings

CATHODE ELECTROCATALYST

DESCRIPTION OF THE INVENTION

In the process of producing alkali metal hydroxide and chlorine by electrolyzing an alkali metal chloride brine, such as an aqueous solution of sodium chloride or potassium chloride, the alkali metal chloride solution is fed into the cell, a voltage is imposed across the cell, chlorine is evolved at the anode, alkali metal hydroxide is produced in the electrolyte in contact with the cathode, and hydrogen is evolved at the cathode.

The overall anode reaction is:

$$2Cl^- \rightarrow Cl_2 + 2e^- \quad (1)$$

while the overall cathode reaction is:

$$2H_2O + 2e^- \rightarrow H_2 + 2OH^- \quad (2)$$

More precisely, the cathode reaction is reported to be:

$$H_2O + e^- \rightarrow H_{ads} + OH^- \quad (3)$$

by which the monatomic hydrogen is adsorbed onto the surface of the cathode. In basic media, the adsorbed hydrogen is reported to be desorbed according to one of two processes:

$$2H_{ads} \rightarrow H_2, \text{ or} \quad (4)$$

$$H_{ads} + H_2O + e^- \rightarrow H_2 + OH^-. \quad (5)$$

The hydrogen desorption step, i.e., reaction (4) or reaction (5), is reported to be the hydrogen overvoltage determining step. That is, it is the rate controlling step and its activation energy corresponds to the cathodic hydrogen overvoltage. The hydrogen evolution potential for the overall reaction (2) is on the order of about 1.5 to 1.6 volts versus a saturated calomel electrode (SCE) on iron in basic media. Approximately 0.4 volt to 0.5 volt represents the hydrogen overvoltage on iron, while 1.11 volts is the equilibrium decomposition voltage. Iron, as used herein to characterize the cathodes, includes elemental iron and iron alloys such as low carbon steels and alloys of iron with manganese, phosphorous, cobalt, nickel, molybdenum, chromium, vanadium, carbon and the like.

According to the method disclosed herein, it has been found that the hydrogen overvoltage may be reduced, for example, to from about 0.05 volt to about 0.20 volt by utilizing a cathode, for example, an iron cathode, having a surface of a transition metal electroplated from an electroless plating solution. The transition metal may be either cobalt or nickel or both. Additionally, tungsten may be present with the other transition metal or metals.

DETAILED DESCRIPTION OF THE INVENTION

Disclosed is a method of electrolyzing aqueous alkali metal chlorides where an electrical potential is imposed across an anode and a cathode so that an electrical current passes from an anode of an electrolytic cell to a cathode of the cell. In this way, chlorine is evolved at the anode and hydrogen is evolved at the cathode. According to the disclosed method, the cathode has a surface thereon in contact with the electrolyte which surface is a transition metal electroplated onto the substrate from an electroless plating solution. The transition metal may be cobalt or nickel or mixtures thereof. Preferably, the transition metal is cobalt. Additionally tungsten may be present on or in the surface coating with the cobalt or nickel or both.

Further disclosed herein is an electrolytic cell having an anode, a cathode, and an external means for imposing an electrical potential between the anode and the cathode. The electrolytic cell is characterized by the cathode having an electroplated coating of a transition metal in contact with the electrolyte. The transition metal may be nickel or cobalt or both. Additionally tungsten may be present in or on the surface coating.

Also disclosed herein is a method of reducing the cathodic hydrogen evolution overvoltage of an iron surface used as a cathode for the evolution of hydrogen. According to the disclosed method, the iron surface is contacted with an electroless plating composition which includes a salt or salts of a transition metal chosen from the group consisting of nickel and cobalt and combinations thereof. Additionally tungsten salts may be present in the electroless plating composition. The iron surface is maintained in contact with the electroless plating composition as an electrical current is passed from an anode in the electroless plating solution to the iron being coated, as a cathode thereby evolving hydrogen at the surface, in this way coating the iron surface with a layer containing the transition metal. Thereafter, the iron substrate, now coated, is removed from the electroless plating solution and may be used as a cathode in contact with an electrolyte, resulting in a hydrogen overvoltage of about 0.05 volt to 0.20 volt.

The substrate is typically an iron substrate. As used herein, iron includes elemental iron, iron alloys such as low carbon steels, and alloys of iron with manganese, phosphorous, cobalt, nickel, chromium, molybdenum, vanadium, carbon, and the like.

The substrate itself is macroscopically permeable to the electrolyte but microscopically impermeable thereto. That is, the substrate is permeable to the bulk flow of electrolyte therethrough between individual elements thereof such as between individual rods or wire or through perforations, but not to the flow of electrolyte into and through the individual elements thereof. The cathode itself may be a perforated plate, expanded metal mesh, metal rods, or the like.

The coating on the cathode is provided by a transition metal chosen from the group consisting of cobalt, nickel, and mixtures thereof. Additionally, tungsten may be present therewith. The coating may also include small amounts of phosphorous or boron. When tungsten is present, the amount of tungsten is typically from about 5 weight percent to about 30 weight percent of the total coating and preferably from about 7 weight percent to about 15 weight percent thereof. The amount of boron or phosphorous, when present, is from about 3 weight percent to about 15 weight percent of the total coating and preferably from about 5 weight percent to about 10 weight percent thereof. The total transition metal content is typically from about 65 to about 92 weight percent of the total coating weight, and preferably from about 75 to about 88 weight percent thereof.

The coating typically has a thickness of in excess of 1 micron and preferably from about 5 to about 100 microns although greater thicknesses may be used without deleterious effect.

According to one exemplification of this invention, a tranistion metal coating, e.g., a coating of nickel or cobalt or both, is deposited onto the ferrous substrate from an electroless plating solution. The electrodeposition, i.e., the electro coating process, is carried out for a period of from about 5 minutes to about 30 minutes, and at a current density of from about 2 amperes per square foot to about 70 amperes per square foot, thereby providing an electroplated coating of from about 1 micron thick to about 20 or more microns thick, and even as thick as 100 microns. In this way an electroplated coating of at least about $3 \times 10^{-5}$ equivalents per square centimeter to about $6 \times 10^{-4}$ equivalent or more per square centimeter is provided on the ferrous substrate.

According to a further exemplification of this invention, an electroless deposited surface coating is first applied to the substrate, and thereafter an electroplated coating is applied atop the electroless coating. The electroless coating may be carried out for a period of from about 2 minutes to about 5 or more hours, and preferably from about 5 minutes to about 30 minutes or even one hour. Thereafter, the electro coating is carried out for a period of from about 5 minutes to about 30 minutes at a current density of from about 2 amperes per square foot to about 70 amperes per square foot; thereby providing an electroplated coating of from at least about 1.0 micron thick to 20 or more microns thick and even as thick as 100 microns. In this way an electroplated coating of at least about $3 \times 10^{-5}$ equivalents per square centimeter to about $6 \times 10^{-4}$ equivalent or more per square centimeter is provided on the ferrous substrate.

The electroless coating on the cathode itself may be provided by standard electroless deposition procedures. For example, when the transition metal is nickel. the electroless deposition may be carried out under either acidic or alkaline conditions. When carried out under acidic conditions, the electroless plating solution typically includes a nickel salt, a hypophosphite, and a complexing agent and buffering agent, such as a salt of a carboxylic acid or borate or both.

Typical nickel salts useful in the method of this invention include $NiCl_2 . 6H_2O$ and $NiSO_4 . 6H_2O$. Satisfactory tungsten salts include sodium tungstate and potassium tungstate. Satisfactory complexing and buffering agents include hydroxyacetic acid, sodium citrate, sodium acetate, sodium sulfate, succinic acid, lactic acid, and propionic acid. Satisfactory hypophosphites include sodium hypophosphite and sodium pyrophosphite. Preferably, electroless deposition is carried out at a pH of from about 4 to 8 and preferably at a pH of about 7. The temperature of the composition is generally from about room temperature, i.e., about 27° C., up to the reflux temperature of the composition.

Where the transition metal is cobalt, the deposition, electrodeposition or both electroless deposit and electrodeposition, is typically carried out in an alkaline electroless plating solution containing a cobalt salt, a reducing agent, and a complexing agent. Typically, the cobalt salt is $CoCl_2 . 6H_2O$ or $CoSO_4 . 7H_2O$, the reducing agent is sodium hypophosphite or sodium pyrophosphite, the complexing agent is sodium citrate, ammonium chloride is present in the solution, and the pH is maintained basic.

Alternatively, the deposition may be carried out in a borohydride solution or an amine boron solution. Amine boron solutions are especially desirable when the substrate is stainless steel. According to another alternative exemplification, the solution may be a borohydride solution where a catalytic amount of sodium borohydride or potassium borohydride is present in the solution.

Typically, the substrate or cathode to be coated is placed in the electroless coating composition, the pH of the composition is adjusted until satisfactory hydrogen evolution is observed and deposition is continued to obtain a coating of satisfactory thickness.

After the deposition, the coated substrate may be heated to a temperature of from about 350° C. to about 550° C.

Cathodes prepared according to the method of this invention typically have a hydrogen evolution potential of from about 1.16 to about 1.4 volts versus a saturated calomel electrode (SCE) in alkaline media while conventional iron cathodes have a hydrogen evolution potential of from about 1.5 to about 1.6 volts versus a saturated calomel electrode (SCE) under the same conditions. In this way, a voltage savings of from about 0.2 volt to about 0.35 volt is obtained when the current density is approximately 190 amperes per square foot.

The electrode so prepared may then be used as the cathode in an electrolytic cell having an anode and a cathode. Most frequently, the anode is a metal anode, for example, a valve metal anode, with an electrocatalytic coating thereon. Valve metals are those metals which form an oxide film when exposed to acidic media under anodic conditions. The valve metals, also referred to as "film forming metals" include titanium, tantalum, tungsten, niobium, and vanadium. Alternatively, the substrate may be silicon. The anode coating is typically an oxide of titanium, tungsten, tantalum, niobium, or vanadium, with an oxide of a platinum group metal such as palladium, rhodium, ruthenium, osmium, iridium or platinum. One particularly desirable coating is a ruthenium dioxide-titanium dioxide coating where both the ruthenium dioxide and titanium dioxide are in the rutile crystal form. Additionally, a small amount of an activating agent such as tin, arsenic, antimony, or bismuth may be present in the coating. In such a cell, the cathode is as described hereinabove.

The cell body is preferably a metal cell body rather than the concrete cell body of the prior art cells. In this way, the electrolyte is substantially free of cementitious products, e.g., calcium compounds. The electrolytic cell may further include a membrane between the anode and cathode, such as an asbestos diaphragm or an organic resin film. Means are provided in combination with the electrolytic cell to impose an electrical potential across the anode and the cathode whereby to cause an electrical current to pass therebetween, evolving chlorine at the anode and hydrogen at the cathode.

Where an electrolyte permeable asbestos diaphragm is used, the catholyte liquor typically contains from about 10 to about 20 weight percent sodium chloride and from about 8 to about 15 weight percent sodium hydroxide.

Alternatively, a perm-selective membrane may be interposed between the anolyte liquor and the catholyte liquor. The perm-selective membrane may be provided by a fluorocarbon or a sulfonated fluorocarbon.

Where either an electrolyte permeable diaphragm or perm-selective membrane is utilized between the anolyte liquor and the catholyte liquor, the cathode reaction has an electrical potential of about 1.1 volts and, as described above, is:

$$2H_2O + 2e^- \rightarrow H_2 + 2OH^- \quad (1)$$

which is the overall reaction for the adsorption step:

$$H_2O + e^- \rightarrow H_{ads} + OH^- \quad (2)$$

and one of two alternative hydrogen desorption steps:

$$2H_{ads} \rightarrow H_2, \text{ or} \quad (3)$$

$$H_{ads} + H_2O + e^- \rightarrow H_2 + OH^-. \quad (4)$$

According to the method of this invention, a cathode of reduced hydrogen overvoltage is utilized. The cathode has a metallic substrate with coating electroplated thereon from an electroless plating solution containing a transition metal chosen from the group consisting of cobalt, nickel, and mixtures thereof. The coating may also contain tungsten. Additionally, as where the coating is deposited from an electroless plating solution, the coating may contain phosphorous or boron.

In the commercial electrolysis of alkali metal chlorides to yield chlorine, hydrogen, and alkali metal hydroxide, the alkali metal chloride may be sodium chloride or potassium chloride. Most commonly, the alkali metal chloride is sodium chloride and the invention will be described with respect to sodium chloride and sodium hydroxide. However, it is to be understood that the method of this invention is equally useful with potassium chloride brines, or, in fact, any process where hydrogen is evolved at a cathode under alkaline conditions.

Sodium chloride is fed to the cell as brine. The brine may be saturated brine, for example, sodium chloride brine containing from about 315 to about 325 grams per liter of sodium chloride, or an unsaturated brine containing less than about 315 grams per liter of sodium chloride, or a supersaturated brine containing in excess of 325 grams per liter of sodium chloride.

According to the method described herein, the electrolysis is carried out in a diaphragm cell. The diaphragm may, in fact, be an electrolyte permeable diaphragm, for example, as provided by an asbestos diaphragm or a resin-treated asbestos diaphragm. Alternatively, the diaphragm may be a microporous diaphragm, for example, provided by microporous halocarbon. According to still another exemplification of this invention, the diaphragm may, in fact, be a permionic membrane, substantially impermeable to the passage of electrolyte therethrough but permeable to the flow of ions therethrough.

Where the diaphragm is an asbestos diaphragm, the diaphragm is most commonly prepared from chrysotile asbestos having fibers in the size range of from about 3T to about 4T, e.g., a mixture of grades 3T and 4T asbestos, as measured by the Quebec Asbestos Producers Association standard screen size. The 3T asbestos has a standard screen size of 1/16 (2 mesh), 9/16 (4 mesh), 4/16 (10 mesh), and 2/16 (pan). The 4T asbestos has a size distribution of 0/16 (2 mesh), 2/16 (4 mesh), 10/16 (10 mesh), and 4/16 (pan). The numbers within the parentheses refer to the mesh size in meshes per inch.

Permeable diaphragms, prepared as described above, allow the anolyte liquor to percolate through the diaphragm at a high enough rate that convective flow, i.e. hydraulic flow, through the diaphragm to the catholyte liquor exceeds the electrolytic flow of hydroxyl ion from the catholyte liquor through the diaphragm to the anolyte liquor. In this way, the pH of the anolyte liquor is maintained acid and the formation of the chlorate ion within the anolyte liquor is suppressed.

The following examples are illustrative.

EXAMPLE I

A series of tests were conducted to determine the effects of electroplating current density and plating time, i.e. combined electroless plating time and electroplating time on the hydrogen overvoltage of cobalt-tungsten coated steel cathodes.

A cobalt-tungsten electroless plating solution was prepared containing:

| | |
|---|---|
| $CoCl_2 \cdot 6H_2O$ | 7.4 grams |
| $Na_2WO_4 \cdot 2H_2O$ | 27.0 grams |
| $Na_2C_6H_5O_7 \cdot 2H_2O$ | 45.6 grams |
| $Na_2B_4O_7 \cdot 10H_2O$ | 15.2 grams |
| $NaH_2PO_2 \cdot H_2O$ | 36.2 grams |
| Distilled water | to 2.0 liters |

The liquid composition had a pH of 9.1. The pH was then adjusted to pH = 7.25 by the addition of 1:1 HCl. The solution was then heated to 85 degrees centigrade and the pH adjusted to 7.2 with NaOH.

Three mild steel strips were then placed in the solution, and electrolessly coated for three hours while the solution was maintained at 88° to 92° centigrade and pH 7.3. The coated strips were then removed from bath and their hydrogen evolution overvoltages determined. At a current density of 100 Amperes per square foot and an electrolyte temperature of 70° centigrade the three electrolessly coated cathodes had a hydrogen overvoltage of 0.363 volt $\neq$ .006 volt.

Thereafter, five steel coupons were individually coated in the above solution. Each coupon was placed in the solution for several seconds, electrocoated at the current density (amperes per square foot) shown in column 2 of Table I, for the time (minutes) shown in column 3 of Table I. Thereafter each electrocoated coupon was removed from the solution, and its cathodic hydrogen evolution overvoltage determined at a current density of 100 Amperes per square foot and an electrolyte temperature of 70° centigrade. The resulting overvoltages are shown in column 4 of Table I.

Table I

| (1) Sample No. | (2) Plating Current Density (amperes/ft$^2$) | (3) Plating Time (min) | (4) Overvoltage (volts) |
|---|---|---|---|
| 1 | 21 | 30 | .06 |
| 2 | 44 | 10 | .15 |
| 3 | 5 | 15 | .15 |
| 4 | 2.5 | 10 | .16 |
| 5 | 22 | 10 | .18 |

EXAMPLE II

A series of tests were conducted to determine the effect of electroplating current density and plating time, i.e., combined electroplating time and electroless plating time, on the hydrogen evolution overvoltage of cobalt coated cathodes.

A cobalt electroless plating solution was prepared containing:

| | |
|---|---|
| $CoCl_2 \cdot 6H_2O$ | 7.4 grams |
| $Na_2C_6H_5O_7 \cdot 2H_2O$ | 45.6 grams |
| $Na_2B_4O_7 \cdot 10H_2O$ | 15.2 grams |
| $NaH_2PO_2 \cdot H_2O$ | 36.2 grams |

-continued

| | |
|---|---|
| Distilled water | to 2.0 liters |

The resulting solution has a pH of 9.5, which was adjusted to pH = 7.6 by the addition of 1:1 HCl.

Two mild steel strips, previously etched in 1:1 HCl, were separately placed in the solution. Gassing was noted. Thereafter the strips were electroplated as cathodes in the solution. Electroplating was carried out at the current density (amperes per square foot) shown in column 2 of Table II for the time (minutes) shown in column 3 of Table II. Thereafter each electrocoated coupon was removed from the solution and its hydrogen overvoltage (volts), shown in column 4 of Table II, determined at a current density of 100 Amperes per square foot and an electrolyte temperature of 70° C.

Table II

| (1) Sample No. | (2) Plating Current Density (amperes/ft$^2$) | (3) Plating Time (min) | (4) Overvoltage (volts) |
|---|---|---|---|
| 1 | 20 | 30 | 0.07 |
| 2 | 20 | 30 | 0.08 |

EXAMPLE III

A series of tests were conducted to determine the effect of an electroplated nickel-cobalt coating atop an electroless plated coating.

In one test a cobalt-nickel electroless plating solution was prepared containing:

| | |
|---|---|
| $CoCl_2 . 6H_2O$ | 7.4 grams |
| $NiCl_2 . 6H_2O$ | 3.7 grams |
| $Na_2C_6H_5O_7 . 2H_2O$ | 45.6 grams |
| $Na_2B_4O_7 . 10 H_2O$ | 15.2 grams |
| $NaH_2PO_2 . H_2O$ | 36.2 grams |
| Distilled water | to 2.0 liters |

The pH of the solution was 8.5, and was adjusted to pH = 7.1 by the addition of 1:1 HCl.

A mild steel strip was placed in the solution for two minutes, and gas evolution was observed. Thereafter a current of 20 Amperes per square foot was passed through the solution to the strip for 20 minutes. The resulting cathode was then removed from the solution and tested as a cathode. It had a hydrogen evolution overvoltage of 0.08 volt at a current density of 100 Amperes per square foot.

In the other test a first cobalt-tungsten electroless plating solution was prepared containing:

| | |
|---|---|
| $CoCl_2 . 6H_2O$ | 7.4 grams |
| $Na_2WO_4 . 2H_2O$ | 27.0 grams |
| $Na_2C_6H_5O_7 . 2H_2O$ | 45.6 grams |
| $Na_2B_4O_7 . 10H_2O$ | 15.2 grams |
| $Na_2H_2PO_2 . H_2O$ | 36.2 grams |

-continued

| | |
|---|---|
| Distilled water | to 2.0 liters |

The pH of the bath was 9.1 and was adjusted to pH = 7.0 by the addition of 1:1 HCl. A steel strip was placed in the solution and electroless plating was carried out for 3 hours without imposition of an electrical current. Thereafter the electroless coated strip was tested as a cathode for hydrogen evolution and had a chlorine evolution overvoltage of 0.36 volt at a current density of 100 Amperes per square foot.

Thereafter the cobalt-tungsten coated electrode was brushed with a wire brush, abraded with COMET® household detergent-abrasive, abraded with emery cloth, and etched in 1:1 HCl.

An electroless coating was then prepared containing:

| | |
|---|---|
| $CoCl_2 . 6H_2O$ | 27.2 grams |
| $NiCl_2 . 6H_2O$ | 11.1 grams |
| $Na_2C_6H_5O_7 . 2H_2O$ | 45.6 grams |
| $Na_2B_4O_7 . 10H_2O$ | 15.2 grams |
| $NaH_2PO_2 . H_2O$ | 36.2 grams |
| Distilled water | to 2.0 liters |

The solution had a pH = 7.1 to 30° centigrade and pH = 6.8 at 67° centigrade. The strip was inserted into the second solution for 30 minutes without the passage of current, and for an additional 30 minutes thereafter with an electroplating current of 20 Amperes per square foot.

After electroplating, the electrode was removed from the plating solution and tested as a cathode. The hydrogen evolution overvoltage was 0.14 volt at a current density of 100 Amperes per square foot.

EXAMPLE IV

A series of tests were conducted to determine the effects of solution composition electroplating current density, and plating time, i.e., electroless plating time and electroplating time on the hydrogen evolution overvoltage of cobalt-nickel coated steel cathodes.

Five cobalt-nickel plating baths were prepared having the composition shown in Table III.

Table III

| Bath | IV - A | IV - B | IV - C | IV - D |
|---|---|---|---|---|
| $CoCl_2 . 6H_2O$ (grams) | 7.4 gm | 22.2 gm | 7.4 gm | 14.8 gm |
| $NiCl_2 . 6H_2O$ (grams) | 3.7 gm | 11.1 gm | 3.7 gm | 3.7 gm |
| $Na_2C_6H_5O_7 . 2H_2O$ (grams) | 45.6 gm | 45.6 gm | 45.6 gm | 45.6 gm |
| $Na_2B_4O_7 . 10H_2O$ (grams) | 15.2 gm | 15.2 gm | 15.2 gm | 15.2 gm |
| $Na_2H_2PO_2 . H_2O$ (grams) | 36.2 gm | 36.2 gm | 36.2 gm | 36.2 gm |
| Distilled water | to 2,000 ml | to 2,000 ml | to 2,000 ml | to 2,000 ml |
| pH (unadjusted) | 8.75 (40° C) | 7.1 (30° C) | 8.5 | 8.2 (26° C) |
| pH (adjusted) | 5.9 | — | — | — |

Steel strips were etched in hydrochloric acid. Thereafter, each sample was immersed in the plating solution shown in column 2 of Table IV without passage of current for the time shown in column 3 of Table IV and thereafter with the passage of current at the current density shown in column 4 of Table IV for the time shown in column 5 of Table IV. The resulting electrodes were then tested as cathodes. The cathodes had the cathodic hydrogen evolution overvoltage shown in column 6 of Table IV at a current density of 100 Amperes per square foot and an electrolyte temperature of 70° centigrade.

Five of the electrodes were examined by X-ray diffraction. These electrodes had been drawn from solutions having the initial cobalt to nickel mole ratios shown in column 6 of Table IV. These surfaces of the electrodes had the cobalt to nickel mole ratios shown in column 7 of Table IV, as determined by X-ray diffraction.

Table IV

| (1) Sample No. | (2) Solution No. | (3) Electroless Plate Time (min) | (4) Electroplate Current Density (Amperes/ft$^2$) | (5) Electroplate Time (min) | (6) Overvoltage (volts) | (7) Initial Ratio of Co/Ni in bath | (8) Ratio of Co/Ni on coated electrode |
|---|---|---|---|---|---|---|---|
| IV-1 | IV-A | 20 min | 30 Amps/ft$^2$ | 20 min | 0.07 volt | — | — |
| IV-2 | IV-C | 2 min | 20 Amps/ft$^2$ | 20 min | 0.08 volt | — | — |
| IV-3 | IV-A | — | 20 Amps/ft$^2$ | 30 min | 0.07 volt | — | — |
| IV-4 | IV-B | — | 40 Amps/ft$^2$ | 15 min | 0.09 volt | 2.005 | 2.80 |
| IV-5 | IV-D | 2 min | 10 Amps/ft$^2$ | 20 min | 0.11 volt | 4.010 | 1.71 |
| IV-6 | IV-D | 2 min | 20 Amps/ft$^2$ | 20 min | 0.11 volt | — | — |
| IV-7 | IV-C | 2 min | 20 Amps/ft$^2$ | 20 min | 0.12 volt | 2.005 | 1.10 |
| IV-9 | IV-B | 20 min | 20 Amps/ft$^2$ | 15 min | 0.14 volt | 2.005 | 1.11 |
| IV-10 | IV-C | — | 20 Amps/ft$^2$ | 20 min | 0.17 volt | 2.005 | 4.73 |

EXAMPLE V

A series of tests were conducted to determine the effect of electroplate current density and plating time on the hydrogen overvoltage of nickel-tungsten coated steel cathodes.

A plating solution was prepared containing:

| | |
|---|---|
| $Na_2WO_4 \cdot 2H_2O$ | 27 grams |
| $NiCl_2 \cdot 6H_2O$ | 7.4 grams |
| $Na_2C_6H_5O_7 \cdot 2H_2O$ | 45.6 grams |
| $Na_2B_4O_7 \cdot 10H_2O$ | 15.2 grams |
| $NaH_2PO_2 \cdot H_2O$ | 36.2 grams |
| Water | to 2,000 milliliters |

Four steel coupons were etched in 1:1 aqueous hydrochloric acid. Thereafter each coupon was inserted in the above solution for the time shown in column 2 of Table V, and electroplating was carried out at the current density shown in column 3 of Table V. Thereafter, the electrodes so prepared were tested as cathodes at a current density of 100 Amperes per square foot and an electrolyte temperature of 70° C., yielding the overvoltages shown in column 4 of Table V.

Table V

| (1) Sample No. | (2) Time (minutes) | (3) Plating Current Density (amperes/ft$^2$) | (4) Overvoltage (volts) |
|---|---|---|---|
| V-1[1/] | 30 minutes | 30 amperes/ft$^2$ | 0.19 |
| V-2 | 20 minutes | 5 amperes/ft$^2$ | 0.22 |
| V-3 | 45 minutes | 21 amperes/ft$^2$ | 0.23 |
| V-4 | 20 minutes | 20 amperes/ft$^2$ | 0.26 |

[1/]Sample V-1 was etched in mixed aqueous nitric acid and hydrochloric acid. Sample V-1 was electrolessly plated for two minutes prior to the commencement of electroplating.

EXAMPLE VI

A test was conducted to determine the effect of the presence of reducing agent in the bath on the coating electroplating therefrom. Two compositions were prepared having the compositions shown in Table VI.

Etched steel coupons were placed in each bath and electroplated for the times shown. Thereafter each electroplated coupon was tested as an electrode for the cathodic evolution of hydrogen. The electrodes had the hydrogen evolution overvoltages shown in Table VI at an electrolyte temperature of 70° C. and a current density of 100 Amperes per square foot.

Table VI

| Test | VI-A | VI-B |
|---|---|---|
| Plating Bath | | |
| $CoCl_2 \cdot 6H_2O$ | 7.5 grams | 7.5 grams |
| $Na_2C_6H_5O_7 \cdot 2H_2O$ | 46 grams | 46 grams |
| $Na_2B_4O_7 \cdot 10H_2O$ | 30 grams | 30 grams |
| $Na_2SO_3$ | None | 43 grams |
| $H_2O$ | to 2.0 liters | to 2.0 liters |
| pH (68° C) | 8.6 | 7.4 |
| Hydrogen overvoltage | 0.34 volts | 0.14 volts |

While the invention has been described with reference to particular exemplifications and embodiments thereof, the scope is not to be so limited except as in the claim appended hereto.

We claim:

1. In a method of conducting electrolysis in an electrolytic cell having an anode in an anolyte compartment and a cathode in a catholyte compartment, which method comprises feeding an alkali metal chloride brine to the anode compartment, passing an electrical current from said anode to said cathode whereby to evolve chlorine at said anode and hydrogen at said cathode, the improvement wherein said cathode has a ferrous substrate with an electroconductive surface thereon, said electroconductive surface being prepared by the method comprising:

inserting the ferrous substrate into an electroless plating solution comprising:

a. a tungsten salt;

b. salts chosen from the group consisting of cobalt salts, nickel salts, and mixtures thereof;

c. a phosphorous containing reducing agent;

d. an acid complexing agent; and e. a buffering agent;

electrolessly depositing a coating from said solution onto said substrate; and subsequently electrolytically depositing from said electroless plating solution a coating of at least $3 \times 10^{-5}$ equivalents per square centimeter of substrate from said solution onto said substrate as a cathode whereby to provide a coating on said substrate comprising tungsten, phosphorous, and a metal chosen from the group consisting of cobalt, nickel, and mixtures thereof.

2. The method of claim 1 comprising electrolytically depositing said coating at the limiting current density of the electrolytic deposition.

3. In a method of conducting electrolysis in an electrolytic cell having an anode in an anolyte compartment and a cathode in a catholyte compartment, which method comprises feeding an alkali metal chloride brine to the anode compartment, passing an electrical current from said anode to said cathode whereby to evolve chlorine at said anode and hydrogen at said cathode, the improvement wherein said cathode has a ferrous substrate with an electroconductive surface thereon, said electroconductive surface being prepared by the method comprising:

inserting the ferrous substrate into a first electroless plating solution comprising:

a. a tungsten salt;

b. salts chosen from the group consisting of cobalt salts, nickel salts, and mixtures thereof;

c. a phosphorous containing reducing agent;

d. an acid complexing agent; and e. a buffering agent;

electrolessly depositing a coating from said solution onto said substrate; and thereafter electrolytically depositing from a second electroless plating solution having the same composition as the first said electroless plating solution a coating of at least $3 \times 10^{-5}$ equivalents per square centimeter of substrate from said solution onto said substrate as a cathode whereby to provide a coating on said substrate comprising tungsten, phosphorous, and a metal chosen from the group consisting of cobalt, nickel, and mixtures thereof.

* * * * *